United States Patent [19]

Buenemann

[11] Patent Number: 4,958,568

[45] Date of Patent: Sep. 25, 1990

[54] MAXIMUM VOLUME REIFENHAUSER SHOTSHELL

[75] Inventor: Morris C. Buenemann, Florissant, Mo.

[73] Assignee: Olin Corporation, Cheshire, Conn.

[21] Appl. No.: 399,210

[22] Filed: Aug. 28, 1989

[51] Int. Cl.[5] ..... F42B 5/30

[52] U.S. Cl. ..... 102/466; 102/467

[58] Field of Search ..... 102/466, 467

[56] References Cited

U.S. PATENT DOCUMENTS

| | | | |
|---|---|---|---|
| 3,105,439 | 10/1963 | Young, Jr. | 102/467 |
| 3,424,089 | 1/1969 | Humpherson | 102/466 |
| 3,565,008 | 2/1971 | Gulley et al. | 102/467 |
| 4,140,058 | 2/1979 | Ballreich et al. | 102/466 |
| 4,481,885 | 11/1984 | Crickson et al. | 102/466 |

FOREIGN PATENT DOCUMENTS

| | | | |
|---|---|---|---|
| 1488360 | 7/1967 | France | 102/467 |
| 1096658 | 12/1967 | United Kingdom . | |

*Primary Examiner*—Charles T. Jordan
*Assistant Examiner*—Rochelle Lieberman
*Attorney, Agent, or Firm*—John R. Wahl

[57] ABSTRACT

A shotshell having a maximum interior volume is disclosed comprising a tubular casing wall made of the biaxially oriented high density polyethylene, and injection molded basewad also made of high density polyethylene molded in place at one end of the tubular casings to close the end. The basewad has a skirt portion fused to the tubular wall to bond the basewad and the tubular casing wall together while maintaining the biaxial integrity of the tubular casing wall.

11 Claims, 1 Drawing Sheet

MAXIMUM VOLUME REIFENHAUSER SHOTSHELL

The present invention generally relates to shotshells and more particularly, is concerned with a Reifenhauser tube shotshell casing having a reduced volume basewad molded in place within one end to produce an increased interior volume shotshell for housing larger shot loads and especially non-toxic shot loads.

A typical conventional shotshell includes a casing composed of an elongated biaxially oriented plastic tube, a primer, a cylindrical filler basewad, and a cup-shaped metal head. The shotshell is assembled by first inserting the basewad in a tight fitting relation in the bottom end portion of the tube. The bottom end portion of the tube with the basewad therein is then placed inside of the metal head and mechanically crimped or locked to the head by a crimp forming a circular rim at the base of the head. This crimped rim mechanically fastens and seals the head, tube, and basewad together. The primer is then centrally positioned through an aperture in the head and frictionally fitted into a central bore through the basewad. The primer may alternatively be positioned simultaneously with the crimping of the metal head. This completes the assembly of the conventional shotshell casing. A propellant charge is then placed in the tube through the open end, followed by an obturator wadding as necessary, and a liner or shot cup containing a load of shot. The open end of the tube is then closed by an inwardly star shaped fold in the end of the tube which extends over the shot load.

A shotshell of such construction generally provides sufficient interior volume for a typical lead shot load. However, due to the toxicity of lead to waterfowl, the environment in general, and health concerns about possible retention of lead in game intended for human consumption, laws have been enacted in many states which substantially limit or even ban the use of traditional lead shot in hunting waterfowl and mandate the use of materials having little or no known toxicity such as steel. Since steel is not as dense as lead, a larger volume load of steel shot is needed to equal the weight of the previous lead shot load when steel is substituted for lead and shotshells. Consequently, a need has existed for a practical approach to increasing the available interior volume of a shotshell casing.

One such method of increasing the interior volume without requiring a significant change in the production equipment used for manufacturing the shotshells is disclosed in my U.S. patent application Ser. No. 260,764, filed Oct. 21, 1988, assigned to the assignee of the present invention, and herein incorporated by reference. This patent application discloses a basewad design providing an increased interior volume to the shotshell wherein it is used. The basewad of this design has a central hub around the axial primer pocket, an annular reduced thickness web portion about the hub, and a skirt portion for frictionally sealing against the inside of the shotshell tube.

The present invention provides a further improvement in providing a basewad having a further reduced volume so as to increase the available interior volume of the shotshell for larger volume shot loads such as required with steel shot. In addition, the present invention provides an improved method for sealing between the basewad and the Reifenhauser tube forming the casing wall of the shotshell.

It is therefore an object of the present invention to provide a molded in place basewad for a shotshell casing to provide an improvement in the interior volume of the shotshell.

It is another object of the present invention to provide an improved sealing method between the casing of the shotshell and the basewad.

These and other objects and features of the invention will become apparent from a reading of the following detailed description when taken in conjunction with the appended drawings and appended claims.

Figure 1:
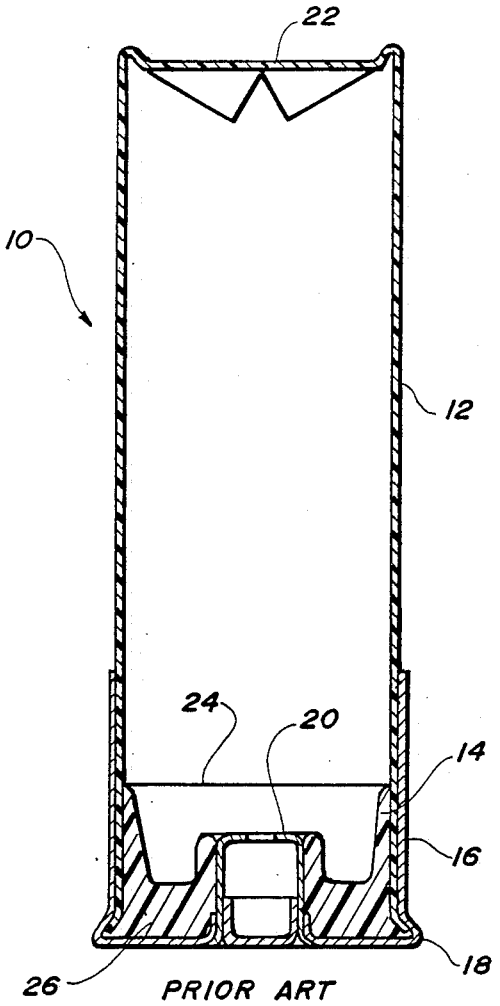
FIG. 1 is a longitudinal sectional view of a prior art shotshell having an increased interior volume for larger shot loads.

Turning now to the drawing, a conventional shotshell 10 is illustrated in FIG. 1. Shotshell 10 comprises a Reifenhauser tubular casing 12 of biaxially oriented plastic, a basewad 14 closing one end of tube 12, and a metal head 16 having a circular crimped rim 18 which crimps tube 12 and basewad 14 together to seal the interface between basewad 14 and tube 12. A primer 20 is inserted through head 16 and frictionally into basewad 14. A propellant charge and shot container may then be loaded through the opposite end 22.

In the prior art plastic basewad 14 designs, the cup shaped skirt portion 24 is relatively thick in order to provide a frictional seal between the interior surface of tube 12 and skirt 24. In addition, the minimum web thickness of base portion 26 is limited to about 0.130 inches in order to provide an effective gas tight seal in conjunction with the crimp 18. This design effectively maximizes the available interior casing volume when the basewad 24 is a separately molded part.

Figure 2:
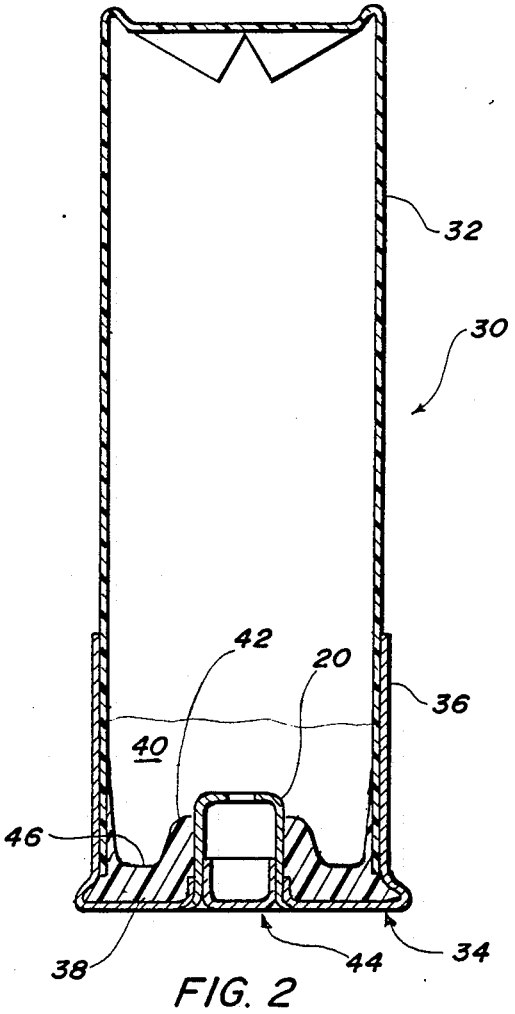
FIG. 2 is a longitudinal sectional view of a shotshell in accordance with the present invention providing a maximum amount of available interior volume.
Figure 3:
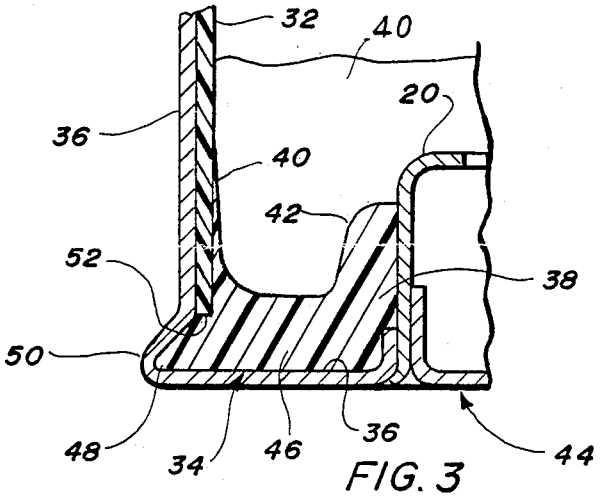
FIG. 3 is a enlarged partial sectional view of the head end of the shotshell of the invention shown in FIG. 2.

The improved maximum volume shotshell in accordance with the present invention is shown in FIG. 2. Shotshell 30 comprises a Reifenhauser biaxially oriented tubular casing 32, a molded in place basewad 34, and a conventional metal head 36. In Applicant's invention, the basewad 34, made of high density polyethylene, is molded in place within casing 32.

The basewad 34 comprises a base portion 38 and a thin skirt portion 40. The skirt portion 40 is a thin, tapered sleeve portion tapering upward from the base portion 38 and having an outer diameter generally equal to that of the inner wall of the tubular casing 32. The skirt portion 40 is directly bonded during molding to the inner wall of the tubular casing 32 to form a tight gas seal therebetween as the plastic material of the skirt portion cools.

The base portion 38 includes an annular hub portion 42 having a central through bore 44 frictionally receiving and supporting a primer 20 therein. The Skirt portion 40 is radially spaced from hub portion 42 by an integral annular web portion 46. Finally, a flange portion 48 extends generally radially outwardly from the web portion 46 around the lower end of the base portion 38.

The metal head 36 is secured to the basewad 34 by a crimped rim 50 mechanically engaging only the flange portion 48 of the basewad 34. Thus the shotshell 30 of the present invention is held together by crimped rim 50 engaging the flange 48 and the basewad 34 in turn being bonded to the Reifenhauser tubular casing 32. A crimp seal by the metal head mechanically engaging both the basewad 34 and the tube 32 is not required.

The basewad 34 of the present invention is formed by injection molding. The high density polyethylene utilized in molding the basewad 34 is preferably of the same composition as is the tubular casing 32. This provides the best bond between the basewad 34 and the tubular casing 32.

Injection molding is preferably done at a ram pressure between about 1000 to 2000 psi and preferably about 1700 psi with a polyethylene melt having a melt flow index of at least 5 and preferably between about 5–6 when using the 21,600 g scale at a temperature of about 190° C. Injection of the melt is preferably done at a temperature of about 450° F. with an injection time of about 10 seconds. This time and temperature, when coupled with conventional mold cooling techniques, is sufficient to obtain adequate bonding while maintaining the biaxial orientation of the tubular casing 32.

The axial thickness of web portion 46 is less than 0.15 inches and preferably may be between on the order of 0.08 inches to 0.125 inches thus substantially reducing the volume required of the basewad 34 which in turn increases the interior volume available within the shotshell 30. In addition, the skirt portion 40 is of reduced thickness which also reduces the basewad volume.

The skirt portion 40 must be very thin for at least two reasons. The first reason is to minimize the volume of the basewad itself. The second reason is to minimize the heat content of the portion of the molten plastic of the basewad 34 which is in contact with the inner wall of the Reifenhauser casing 32 so that the biaxial orientation of the casing 32 remains intact while the molded in place basewad 34 is cooled to a solid state within tubular casing 32 so as to close one end of the tubular casing 32. Contact between the hot melt of the skirt portion 40 and the inner surface of the Reifenhauser tube causes the inner surface of the tube to melt and fuse with the skirt portion thus bonding them together. Keeping the skirt portion thin limits the melting of the tubing to a very thin surface layer of the tube as it is cooled. Thus the biaxial orientation of the tube as a whole is retained while establishing a tight seal between the skirt portion 40 and the casing 32.

The flange portion 48 provides a gripping point for crimping the rim 50 so as to secure head 36 thereto. The rim 50 is used to permit proper chambering and mechanical extraction of the shotshell from the weapons chamber.

Alternatively, metal head 36 may be eliminated in an all plastic shotshell design. The seal between skirt portion 40 and the tubular casing 32 is sufficient to prevent gas leakage and will maintain a sufficient bond to permit extraction of the spent shotshell without separation of the casing from the basewad. The flange portion 48 may therefore be utilized alone to engage with a suitable extraction member in the weapon in which the shotshell is chambered.

In the preferred embodiment shown in FIG. 2, the thinnest part of the web portion 46 is slightly thicker axially than the distance from the end 52 of tubular casing 32 to the generally flat end of the basewad 34 which abuts the inner surface of metal head 36. This provides sufficient basewad web material to provide adequate primer support to prevent excessive flexure. This ensures adequate primer sensitivity when the primer is impacted by the firing pin of the weapon in which shotshell is used.

In summary, because the basewad 34 is molded in place, crimp engagement of flange 48 and end 52 of the tubular casing 32 by the crimp 50 of metal head 36 is no longer essential. This may permit the elimination of head 36 in all plastic shotshell designs. The volume of material comprising basewad 34 is also minimized while still retaining sufficient structural rigidity in the basewad 34 to support the primer 20 and adequately seal the head end of the shotshell against gas leakage. Accordingly, a shotshell 30 is formed which has a maximum possible interior volume.

It is thought that the present invention and many of its intended advantages will be understood from the foregoing description and it will be apparent that various changes will be made in the form, construction, and arrangement of the parts thereof without departing from the spirit and scope of the invention or sacrificing all of its material advantages, the form herein before described being merely preferred or exemplary embodiment thereof.

What is claimed is:

1. A shotshell comprising:

a tubular casing wall made of a biaxially oriented high density polyethylene having a pair of ends; and an injection molded high density polyethylene basewad molded in place at one end of said tubular casing wall closing and sealing said end, said basewad having a thin skirt portion having a radial thickness generally less than said casing wall fused to the inside surface of said tubular casing wall so as to bond and seal said skirt portion of said basewad and said tubular casing wall together while maintaining said biaxial orientation of said tubular casing wall adjacent said skirt portion.

2. The shotshell according to claim 1 further comprising a generally cup shaped metal head over said closed end, said head having a rim crimp engaged only with said basewad, said rim mechanically interlocking said basewad and head together.

3. The shotshell according to claim 2 wherein said basewad further comprises a central hub portion and an annular web portion about said hub portion, said web portion having a thickness of less than 0.15 inches.

4. The shotshell according to claim 3 wherein said web portion extends axially within said one end of said tubular casing wall and said one end is axially spaced from said rim.

5. The shotshell according to claim 1 wherein said basewad has a melt flow index of at least 5 using the 21600 gram scale.

6. The shotshell according to claim 1 wherein said web portion has an axial thickness of less than 0.15 inch.

7. A shotshell comprising: a biaxially oriented tubular casing wall made of a high density polyethylene having a pair of open ends; and an injection molded basewad made of said high density polyethylene molded in place at one of said open ends so as to close and seal said end, said basewad having an axially extending annular skirt portion having a radial thickness generally less than said casing wall fused to the inside surface of said tubular casing so as to bond said skirt portion of said basewad to said wall while maintaining said biaxial orientation of said tubular casing wall adjacent said skirt portion, a central hub portion for supporting a primer, and an annular web portion about said hub portion spacing and supporting said skirt portion from said hub portion, said web portion having an axial thickness less than 0.15 inches.

8. The shotshell according to claim 7 further comprising a generally cup shaped metal head over said closed end, said head having an annular rim crimp engaged only with said basewad, said rim mechanically interlocking said basewad and head together.

9. The shotshell according to claim 8 wherein said web portion only partially extends axially within said one end of said tubular casing wall and said one end is spaced axially from said rim.

10. The shotshell according to claim 9 wherein said web portion has an axial thickness of between about 0.08 and about 0.125 inches.

11. A shotshell comprising:

a biaxially oriented high density polyethylene tubular casing wall having a pair of open ends; and an injection molded basewad formed of high density polyethylene having a melt flow index of between about 5 and 6 molded in place at one of said open ends of said tubular wall so as to close and seal said one end;

said basewad comprising a base portion and a thin skirt portion having a radial thickness generally less than that of said wall extending axially from said base portion into said tubular casing, said base portion having a central annular hub portion for supporting a primer, an annular web portion supporting and radially spacing said skirt portion from said hub portion, and an annular flange portion extending radially outwardly from the perimeter of said base portion, said skirt portion being fused with the inside surface of said wall during the molding in place of said basewad so as to bond said skirt portion to said wall and form a seal therebetween without destroying the biaxial orientation of said tubular casing wall adjacent said skirt portion.

* * * * *